US007967921B2

(12) United States Patent
Hattori et al.

(10) Patent No.: US 7,967,921 B2
(45) Date of Patent: Jun. 28, 2011

(54) CARBURIZED COMPONENT AND MANUFACTURING METHOD THEREOF

(75) Inventors: Atsushi Hattori, Aichi (JP); Takashi Kano, Aichi (JP)

(73) Assignee: Daido Steel Co., Ltd., Aichi (JP)

( * ) Notice: Subject to any disclaimer, the term of this patent is extended or adjusted under 35 U.S.C. 154(b) by 572 days.

(21) Appl. No.: 11/785,629

(22) Filed: Apr. 19, 2007

(65) Prior Publication Data

US 2007/0246126 A1 Oct. 25, 2007

(30) Foreign Application Priority Data

Apr. 20, 2006 (JP) ..... 2006-116308
Feb. 16, 2007 (JP) ..... 2007-035632

(51) Int. Cl.
*C22C 8/22* (2006.01)
*C22C 38/18* (2006.01)

(52) U.S. Cl. ..... 148/319; 420/104

(58) Field of Classification Search ..... 148/319; 420/104

See application file for complete search history.

(56) References Cited

U.S. PATENT DOCUMENTS

| | | | | |
|---|---|---|---|---|
| 5,084,116 | A * | 1/1992 | Mitamura | 148/319 |
| 2004/0182480 | A1 | 9/2004 | Inoue et al. | |
| 2005/0133120 | A1 | 6/2005 | Walenta et al. | |
| 2006/0130935 | A1 | 6/2006 | Hattori et al. | |

FOREIGN PATENT DOCUMENTS

| | | | |
|---|---|---|---|
| EP | 1 715 072 | A1 | 10/2006 |
| JP | 58-126975 | A | 7/1983 |
| JP | 6-25823 | A | 2/1994 |
| JP | 6-158266 | A | 6/1994 |
| JP | 8-3629 | A | 1/1996 |
| JP | 3033349 | B2 | 2/2000 |
| JP | 3385722 | B2 | 1/2003 |
| JP | 2004-285384 | A | 10/2004 |
| JP | 2006-161141 | A | 6/2006 |
| WO | WO 2005/068675 | A1 | 7/2005 |

OTHER PUBLICATIONS

ASM International, Materials Park, Ohio, Properties and Selection: Irons, Steels, and High Performance Alloys, "Classification and Designation of Carbon and Low Alloy Steels", pp. 144-147, Mar. 1990.*

* cited by examiner

*Primary Examiner* — Roy King
*Assistant Examiner* — Jessee R. Roe
(74) *Attorney, Agent, or Firm* — Arent Fox LLP

(57) ABSTRACT

A carburized component with a base metal containing 0.10% to 0.40% C, 0.05% to 0.8% Si, 0.35% to 1.2% Mn, 2.0% to 5.0% Cr, remnant including Fe and inevitable impurities, a carburized layer formed on a surface layer portion, a grain boundary oxidized layer depth of 1 μm or less on a surface thereof and an average C concentration of 1.5% to 4.0% at 25 μm deep from the surface, and adjusted so as to satisfy 1.76 SC−1.06<WCr<1.76 SC+0.94, wherein said carburized layer also has a carbide area ratio of 15% to 60% at 25 μm deep from the surface, a fine carbide area ratio, a dimension of 0.5 μm to 10 μm, and constitutes 80% or more of the total and 70% by volume or more of said fine carbide is $M_3C$ type.

4 Claims, 4 Drawing Sheets

(a)

(b)

Between d and e

Fine Carbide precipitation

Between e to f

Carbide Growth

50 μm

CARBURIZED COMPONENT AND MANUFACTURING METHOD THEREOF

RELATED APPLICATIONS

This application claims the priorities of Japanese Patent Applications No. 2006-116308 and No. 2007-035632 filed on Apr. 20, 2006 and Feb. 16, 2007, which is incorporated herein by reference.

BACKGROUND OF THE INVENTION

1. Field of the Invention

The present invention relates to a carburized component and a manufacturing method thereof.

2. Description of the Related Art

[Patent Reference 1]

Japanese Patent Publication No. H6-158266

[Patent Reference 2]

Japanese Patent Publication No. H6-25823

A gear as a mechanical transmission part of an automobile or the like is a part having problems of dedendum breakage occurring at a dedendum upon where bending stress acts, and breakage caused around a pitching point by sliding (pitching phenomenon). In order to satisfy characteristics capable of enduring these, a technique has been widely used to apply a carburizing process to a component surface so as to improve surface fatigue strength, and further improvement has been achieved by combining various kinds of materials and annealing. Also, recently a material has been developed in order to suppress a grain boundary oxidized layer and an abnormally-carburized layer when carburizing, which are considered harmful by causing dedendum breakage, and also further strength improvement has been achieved by shot-peening.

On the other hand, it's been revealed that when sliding repeatedly occurs on a gear tooth surface, the pitching phenomenon is caused mainly by frictional heat thereof increasing a temperature of an area directly below the tooth surface in a range of approximately 200° C. to 300° C., so as to cause softening of a quenched structure (martensite). Therefore, in order to improve pitching breakage, it is considered that it is effective to prevent a material from softening in a temperature range of approximately 200° C. to 300° C., and a material added Si, Mo, V or the like, as an alloy element having excellent softening resistance in this temperature range, has been developed.

SUMMARY OF THE INVENTION

However, adding Si, Mo and V, in order to improve softening resistance of a matrix itself, results in high-alloying of materials, so as that problems occur in manufacturability (workability), and moreover a material cost increases. Also, there is a means of improving softening resistance by high-carburizing so as to disperse carbide in a matrix, however in this case the high-carburizing causes problems such as manufacturability (workability) deterioration, production of bulky crystallized carbide or toughness deterioration.

The object of the present invention is to provide a carburized component having excellent surface fatigue strength (especially pitching resistance) by improving softening resistance of low-alloy and low-carbon materials, and a manufacturing method thereof.

In order to solve the above problems, a carburized component of the present inventions is characterized by having a base metal comprised of a steel containing:

C: 0.10% by mass to 0.40% by mass;

Si: 0.05% by mass to 0.8% by mass;

Mn: 0.35% by mass to 1.2% by mass;

Cr: 2.0% by mass to 6.0% by mass;

both ends inclusive, and remnant including Fe and inevitable impurities, having a carburized layer formed on a surface layer portion of said base metal, having a grain boundary oxidized layer depth of 1 μm or less on a surface thereof and an average C concentration SC (referred to "surface C concentration" hereinafter) of 1.5% by mass to 4.0% by mass, both ends inclusive, at 25 μm deep from the surface, and adjusted so as to satisfy:

$$1.76SC-1.06<WCr<1.76SC+0.94 \quad (1)$$

where WCr represents a Cr content of the steel composing said base metal, wherein said carburized layer also has, in a sectional structure in depth direction thereof, a carbide area ratio of 15% to 60%, both ends inclusive, at 25 μm deep from the surface, a fine carbide area ratio, having a dimension of 0.5 μm to 10 μm, both ends inclusive, constitutes 80% or more of the total carbide area, and further $M_3C$ type carbide accounts for 70% by volume or more of said fine carbide.

A manufacturing method of the carburized component of the present invention is characterized that a first carburizing process is applied to the base metal composed of said steel at a temperature of an Acm point a solid-solution temperature of carbide on a hypereutectoid side to austenite phase or higher by vacuum carburizing, afterward quenched rapidly to an A1 point (austenite→pearlite eutectoid transformation point) or lower, and then a second carburizing process is applied thereto at a temperature of the A1 point to the Acm point, both ends inclusive, by vacuum carburizing.

The present invention has a fundamental idea of improving surface fatigue reisistivity of a component, especially pitching resistance, by increasing a C concentration of a carburized layer so as to precipitate a relatively large amount of fine carbide on a base metal matrix. A usual carburizing process is generally an eutectoid carburizing process of processing a steel product surface by targeting eutectoid C composition (C: 0.8% by mass), however the present invention intends to increase a carbide production amount, having hypereutectoid C composition (C: exceeding 0.8% by mass) by targeting C composition of the carburized layer. For this purpose, it is absolutely necessary to add an appropriate Cr amount (2.0% by mass to 6.0% by mass, both ends inclusive) as a carbide producing element to the steel. Also, Cr addition improves hardenability, and suppresses softening of a quenched structure of the carburizing layer (mainly caused by martensite decomposition) when a temperature of the steel member increases by friction heat or the like.

However, with the steel composition having Cr added as described above, by simply increasing a C concentration of the carburizing layer, a carbide structure, that is contributive to improving surface fatigue strength of the component, cannot be conveniently obtained. That is, Cr contained steel tends to have Cr-type carbide precipitated at an austenite crystal grain boundary, and therefore, when a solid-solute carbide amount of the austenite composing the carburizing layer is increased to reach to a hypereutectoid range, bulky cancellous Cr-type carbide is grown along the grain boundary, so as to conversely lead to deterioration of the surface fatigue strength and bending fatigue strength. Also, Cr tends to distribute in carbide of the highly-concentrated carburized layer, and the Cr content in the matrix decreases, along with the carbide precipitation, so that the hardenability decreases and especially an imperfectly-quenched phase is likely to occur at the boundary between the matrix and the carbide. Accordingly, in order to secure the hardenability of the matrix, it is also important to achieve an appropriate Cr amount according to the surface C concentration and the carbide amount after carburizing as a purpose.

The present inventors keenly studied how to mainly produce fine carbide contributive to improving surface fatigue strength, though adopting a hypereutectoid C concentration, and still suppressing cancellous carbide production as described above as much as possible. As a result, they discovered the following findings and completed the present invention.

(a) In order to secure a required carbide production amount, the C concentration of the carburized layer is increased to reach to a hypereutectoid range (1.5% by mass to 4.0% by mass, both ends inclusive), and a lower limit of the Cr content of the base metal is increased to 2% by mass, whereas in order to suppress cancellous carbide production, a higher limit of the Cr content is limited to 6% by mass.

(b) Having a Cr content range and a C concentration of the carburized layer as (a), Cr tends to distribute in carbide of the highly-concentrated carburized layer, and the Cr content of the matrix decreases along with the carbide precipitation, so that the hardenability decreases, and an imperfectly-quenched phase is likely to occur especially at the boundary between the matrix and the carbide. Therefore, the hardenability of the matrix is secured by controlling Cr content according to the surface C concentration SC after carburizing as a purpose (The equation (1) stated above). Herewith, when a temperature of the member increases by friction heat or the like, softening of a quenched structure of the carburized layer is less likely to occur.

(c) An appropriate amount of Si, having a low solid-solubility into carbide, can be added to the base metal, so as to increase a Si concentration of the matrix, and suppress bulky growth of the carbide. With this respect, a Si additive amount to the base metal is set to 0.05% by mass and 0.8% by mass, both ends inclusive. However, Si is an element that accelerates grain boundary oxidization in a case of general gas carburizing, and this grain boundary oxidized layer causes deterioration of shock strength and fatigue strength of the dedendum. However, the present invention employs vacuum carburizing (for example, atmosphere pressure is 2000 Pa or less), so as to effectively suppress problems of grain boundary oxidization despite of Si inclusion, and enable to maintain depth of the grain boundary oxidized layer of the carburized layer surface of 1 μm or less.

(d) Unique two carburizing processes of the present invention realize a carburized layer steel structure having a large amount of finely-dispersed carbide (carbide area ratio is 15% to 60%, both ends inclusive, and a fine carbide area ratio, having a dimension of 0.5 μm to 10 μm, both ends inclusive, constitutes 80% or more of the total carbide area), which was impossible to be realized conventionally. That is, by the first carburizing process in a solid-solution range of the carbide (Acm point or higher), a carbide solid-solution amount of the austenite is increased to reach to a hypereutectoid range, and rapidly quenched afterward, so as to obtain a matrix structure having supersaturated solid-solute C, which have suppressed bulky carbide precipitation. Subsequently, by increasing the temperature again to be between the A1 point (an eutectoid transformation point) and the Acm point, carbide precipitated nuclei are produced densely in the supersaturated matrix structure, and then by applying the second carburizing process in that state, without precipitated nuclei growing bulky respectively, a structure having a great amount of fine dispersed carbide can be obtained, so as to improve the surface fatigue strength significantly.

That is, as shown in FIGS. 2(*a*) and (*b*), first, the first carburizing process is conducted at a temperature as high as the Acm point or higher having a large C solid-solubility limit and also precipitating no carbide, so as to prevent nuclei from precipitating (between a and b). Next, quenching rapidly to the A1 point or lower turns a state to have C supersaturatedly solid-solved (between b and c). Afterward, by heating to a temperature of the A1 point or higher, fine precipitated nuclei of carbide uniformly precipitates from the base metal having supersaturated C (between d and e: referred to the upper part of FIG. 3), and then the precipitated nuclei are grown by the second carburizing process (between e and f: referred to the lower part of FIG. 3). Conducting these multiple-stage carburizing processes enables, without precipitating cancellous carbide, to conduct carburization with a high C concentration having controlled carbide by dispersing finely. Whereas, as shown in FIG. 4, carburizing to a high C concentration range, which is less than the Acm point, allows cancellous bulky carbide to be very easily produced. In addition, an upper limit of the first carburizing process temperature is 1100° C.

Hereinafter, limitation reasons for each range value of the present invention will be explained.

[Base Metal]

(1) C: 0.10% by mass to 0.40% by mass, both ends inclusive

C is an essential element to secure strength of the component, and required to be contained 0.10% by mass or more. On the other hand, excessive C content increases material hardness, resulting in machinability deterioration and having difficulty in component machining, so that C content should be 0.40% or lower.

(1) Si: 0.05% by mass to 0.8% by mass, both ends inclusive

Si is an element contained as a deoxidizing agent in a solute state. Also, as explained above, Si addition of an appropriate amount has an effect of suppressing bulky growth of carbide. Furthermore, in a case of precipitating a relatively large amount of carbide like the present invention, Si, having low solid-solubility to carbide, is more concentrated in the matrix, so as to achieve an effect of improving softening resistance of the matrix further more. In order to obtain these effects, it is required to contain Si of 0.05% by mass or higher (more preferably 0.3% by mass or higher). On the other hand, excessive Si content inhibits carbide precipitation and carburized surface reaction, so as to significantly deteriorate carburizability and also ductility, it's more likely to cause crack at deformation processing, and therefore Si should be contained 0.8% by mass or lower (more preferably 0.5% by mass).

(3) Cr: 2.0% by mass to 6.0% by mass, both ends inclusive

Cr is essential as a carbide producing element and as a hardenability improving element. Cr content of lower than 2.0% by mass causes insufficient carbide production amount and hardenability deterioration, so as to cause poor surface fatigue strength of the carburized layer and poor softening resisitivity. Whereas, Cr content of exceeding 6.0% by mass increases material hardness so as to deteriorate machinability, and also causes cancellous carbide production at the grain boundary more easily so as to conversely deteriorate the surface fatigue strength. Furthermore, according to increase of the Cr content, the Acm point shifts to the lower C side, so that excessive increase of the Cr content makes it difficult to suppress carbide production at the first carburizing process. Cr content of the base metal is more preferably 2.5% by mass to 5.0% by mass, both ends inclusive.

(4) A relation of Cr content WCr and surface C concentration SC:

$$1.76SC-1.06<WCr<1.76SC+0.94 \quad (1)$$

C binds to Cr so as to produce Cr carbide. As a result, a Cr absentee layer occurs around carbide, and hardenability is not secured around that area, resulting in a risk of causing imperfect quenching. The lower limit of the Cr content has to be set to a higher value, as the surface C concentration (or carbide amount) after carburizing as a purpose is higher. In the present invention, taking the matrix composition after carburization into consideration, the lower limit of the Cr content is set to have hardenability equivalent to at least JIS-SCR420H or more. Whereas, excessive Cr addition to the surface C concentration increases a solid-solute Cr content of the matrix, so as to increase material hardness, causing machinability deterioration of the base metal, and therefore the upper limit of the Cr content is set as above. Additionally, the range satisfying the above equation (1) shows in FIG. 1 of the diagram. Also, the relation of the Cr content WCr and the surface C concentration SC is more preferably to satisfy $$1.76SC-0.65<WCr<1.76SC+0.35 \quad (1)'$$

(5) Mn: 0.35% by mass to 1.2% by mass, both ends inclusive

Mn is contained as a deoxidizing agent in a solute state, and has an effect of improving hardenability. However, Mn content of less than 0.35% by mass cannot secure sufficient hardenability (especially for a large component). On the other hand, the present invention secures hardenability mainly with Cr, so that in order to decrease material hardness and secure machinability, Mn of 1.2% by mass or less is contained, and preferably 0.5% by mass or less.

[Carburized Layer]

(6) An average C concentration (surface C concentration) of 1.5% by mass to 4.0% by mass, both ends inclusive, at 25 μm deep from the surface The surface C concentration of less than 1.5% by mass can not secure surface fatigue strength sufficiently due to the insufficient carbide production amount (it is defined at 25 μm deep from the steel surface, because hardness at said area is important regarding the surface fatigue strength). Whereas, excessive C content causes bulky carbide production and also insufficient hardenability of the matrix, so as to lead the strength deterioration. Therefore, the surface C concentration is set to 4.0% by mass or less. The lower limit of the surface C concentration is preferably set to 1.6% by mass or more, more preferably 1.7% by mass or more, and further more preferably 1.8% by mass or more. On the other hand, the upper limit of the surface C concentration is preferably set to 3.0% by mass or less.

(7) Carbide area ratio of 15% to 60%, both ends inclusive, at 25 μm deep from the surface, in a sectional structure in depth direction thereof Carbide precipitation increases surface hardness as well as improves softening resistance so as to improve surface fatigue strength. However, at 25 μm deep from the surface, the carbide area ratio of less than 15% does not increase surface hardness sufficiently, and does not improve the softening resistance sufficiently. Whereas, when the carbide area ratio exceeds 60%, as the carbide grows bigger, the carbide is more likely precipitated in cancellous form along the crystal grain boundary, so as to lead deterioration of the surface fatigue strength and the bending fatigue strength. The above carbide area ratio is more preferably set to 20% to 45%, both ends inclusive.

(8) An area ratio of fine carbide, having a dimension of 0.5 μm to 10 μm, both ends inclusive, is 80% or more of the total carbide area Carbide exists as a hard particle, and can be a starting point of fatigue breakdown similarly to nonmetal inclusions such as Al oxide and Ti nitride. Therefore, carbide smaller in particle size is preferred, and in order to avoid being as a starting point of fatigue breakdown, the carbide is precipitated in finely dispersed manner so as to have carbide of 10 μm or less constituting 80% or more of the total carbide area. Additionally, the carbide area ratio measurement is conducted by extracting visibly recognizable carbide on an observation picture image of the sectional structure in depth direction by a scanning electron microscope (SEM). Accordingly, visibly unrecognizable carbide on the picture image, having size of less than 0.5 μm, is excluded from the area ratio measurement (also carbide having less than said size has little influence to the carburized layer surface fatigue strength). Also, the carbide area ratio at 25 μm deep from the surface is a value measured using the observation picture image in a visible range of plus and minus 20 μm from a center position of 25 μm deep. Further, A carbide size is a maximum distance between circumscribed parallel lines measured on the picture image. Additionally, the area ratio of fine carbide, having a dimension of 0.5 μm to 10 μm, both ends inclusive, is preferably 90% or more, more preferably 95% or more, and further more preferably 98% or more. Also, it is preferable that carbide exceeding 15 μm is not present.

(9) $M_3C$ type carbide constitutes 70% by volume or more of the above-described fine carbide (M: metal element)

As Cr-type carbide produced by carburizing process has a higher Cr concentration in the base metal, it changes as $M_2C$-type to $M_7C_4$-type to $M_{23}C_6$type. $M_{23}C_6$type is carbide likely to be a problem such as a cause of grain boundary corrosion sensitization of stainless steel having significant high Cr content or the like, but it is not produced in the Cr content range adopted for the steel to be carburized, so that it is also not substantially relevant to the present invention. Whereas, $M_7C_4$-type is carbide likely to be produced in a case that a conventional steel to be carburized has high Cr content, and the produced amount varies significantly depending on variation in the Cr concentration and the carburizing C amount, and that is a great disadvantage in respect of securing surface fatigue strength stably on mass production level. FIG. 1 shows a diagram showing change of the carbide type by the surface C concentration and the Cr concentration, and the present invention employs the surface C concentration (1.5% by mass to 4.0% by mass, both ends inclusive), the Cr concentration (2.0% by mass to 8.0% by mass, both ends inclusive) and the composition range with the equation (1), so as to produce mainly $M_3C$-type carbide (especially 70% or more), which is relatively less likely to be influenced by variation in the Cr concentration and the carburizing C amount, resulting in suppressing occurrence of variation in the surface fatigue strength. Also, the produced carbide can be identified easily weather it is $M_7C_3$-type or $M_3C$-type by measuring a X-ray diffraction profile on the carburized layer surface by a diffractometer method, the $M_3C$-type carbide volume ratio accounted of the total fine carbide can be calculated with the ratio of the maximum peak area of the $M_3C$-type carbide to the maximum diffracted peak total area of each carbide protruding from the diffraction base line.

(10) Grain boundary oxidized layer depth is 1 μm or less

The grain boundary oxidized layer causes deterioration of the surface fatigue strength, and deeper the depth is, higher the deterioration level is. Therefore, by applying a vacuum carburizing process, the grain boundary oxidized layer depth from the steel surface after the process is set to 1 μm or less.

Next, the steel composing the base metal and further elements that can be added will be explained.

(11) Mo: 0.2% by mass to 1.0% by mass, both ends inclusive

Mo has effects of bonding to C so as to produce carbide similarly to Cr, and of increasing softening resistance in a temperature range of 200° C. to 300° C. so as to improve surface fatigue strength. In order to obtain these effects, it is preferable to contain Mo of 0.2% by mass or more. Whereas, the excessive addition increases material hardness so as to deteriorate machinability as well as increase material costs, and therefore it is preferable to contain Mo of 1.0% by mass or less. Also, as stated above, the present invention suppresses alloy element addition except Cr, so that it is more preferable to include Mo of 0.65% by mass or less.

(12) V: 0.2% by mass to 1.0% by mass, both ends inclusive

V has effects of bonding to C so as to produce carbide similarly to Cr and Mo, and of increasing softening resistance by MC-type carbide production so as to improve pitching characteristics. In order to obtain these effects, it is preferable to include Mo of 0.2% by mass or more. Whereas, the excessive addition increases material hardness so as to deteriorate machinability, and therefore it is preferable to set the upper limit to content of 1.0% by mass or less. Also, as stated above, the present invention suppresses alloy element addition except Cr, so that it is more preferable to include V of 0.65% by mass or less.

(13) Nb: 0.02% by mass to 0.12% by mass, both ends inclusive

Nb has effects of micronizing crystal grains so as to increase toughness, and therefore in order to obtain these effects, Nb can be added in a range of 0.12% by mass or less. Also, in order to obtain the effects fully, it is preferable to contain Nb of 0.02% by mass or more.

In addition, regarding to a manufacturing method of a carburized component of the present invention, after the second carburizing process, a peening process can be applied as required, so as to achieve further high-strength. As the peening process, shot-peeing (S/P) or water-jet-peening (W/J/P) can be applied.

As a reference, the invention disclosed in the patent reference 2 and the present invention will be compared below.

Tables 1 and 2 of the patent reference 2 disclose examples within the constituent range and the surface C concentration range of the present invention. Then, regarding to the carbide ratio produced on the surface of the examples, it is disclosed that carbide having $M_7C_3$ composition are produced at the ratio of 30% or more. However, as obvious from the diagram of FIG. 1 mentioned above, according to the surface C concentration range and the Cr range of the present invention, carbide produced on the surface should contain carbide having $M_3C$ composition accounted for at least 70% or more, and the examples of the present invention explained later also confirms this point. Accordingly, the examples disclosed in the patent reference 2 do not satisfy a requirement of the present invention, that is "$M_3C$ type carbide constitutes 70% or more of carbide of 10 μm or less". Also, the patent reference 2 obtains examples by gas carburizing (referred to Paragraph 0029), whereas the present invention uses vacuum carburizing as a requirement, and they also differ in this point.

BEST MODE FOR CARRYING OUT THE INVENTION

EXAMPLES

Figure 1:
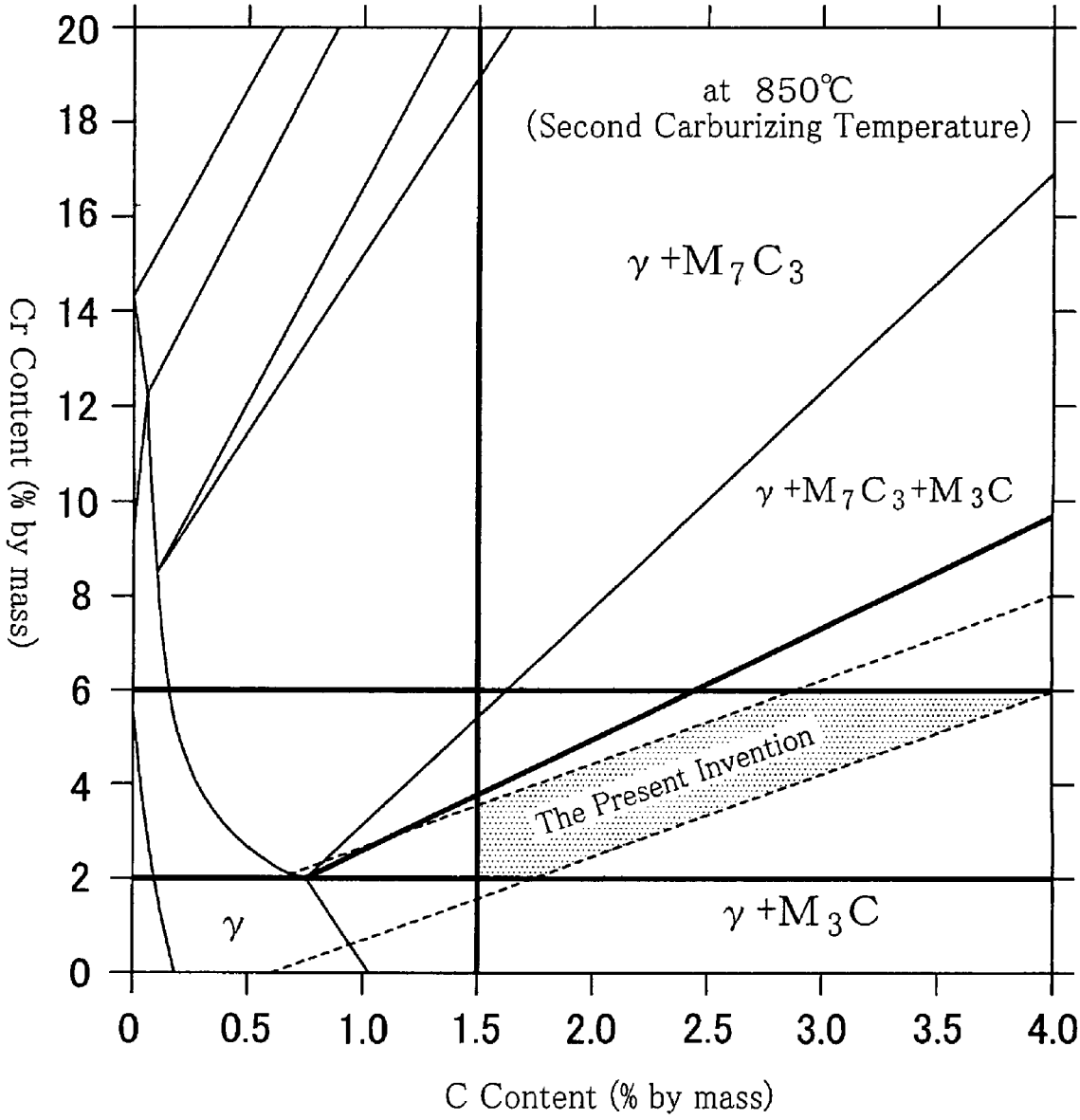
FIG. 1 shows a diagram showing change of the carbide type by the surface C concentration and the Cr concentration.
Figure 2:
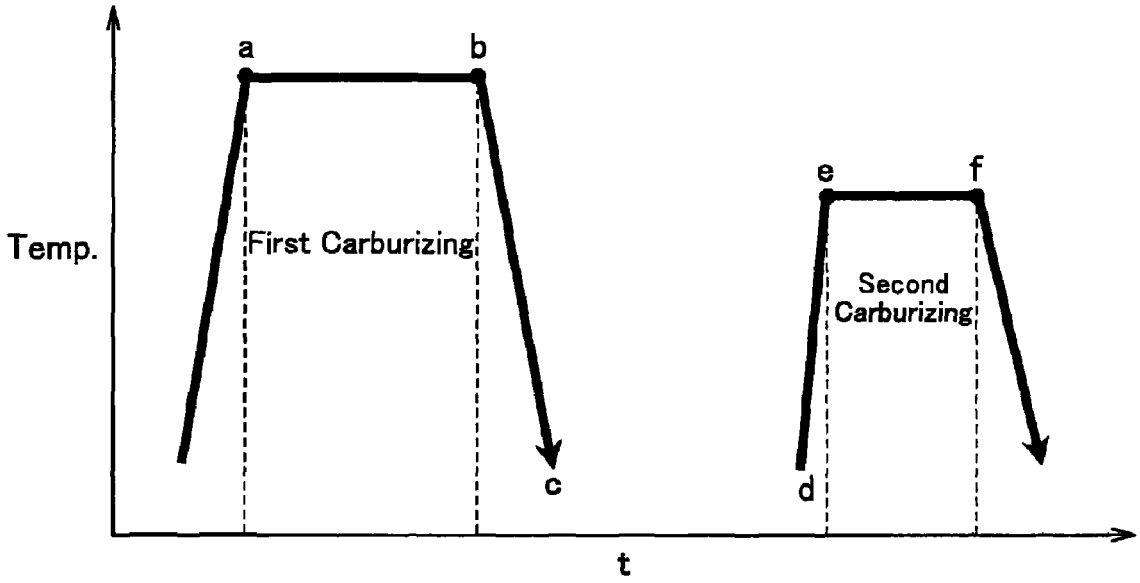
FIG. 2 shows explanatory diagrams for carburizing process.
Figure 2:
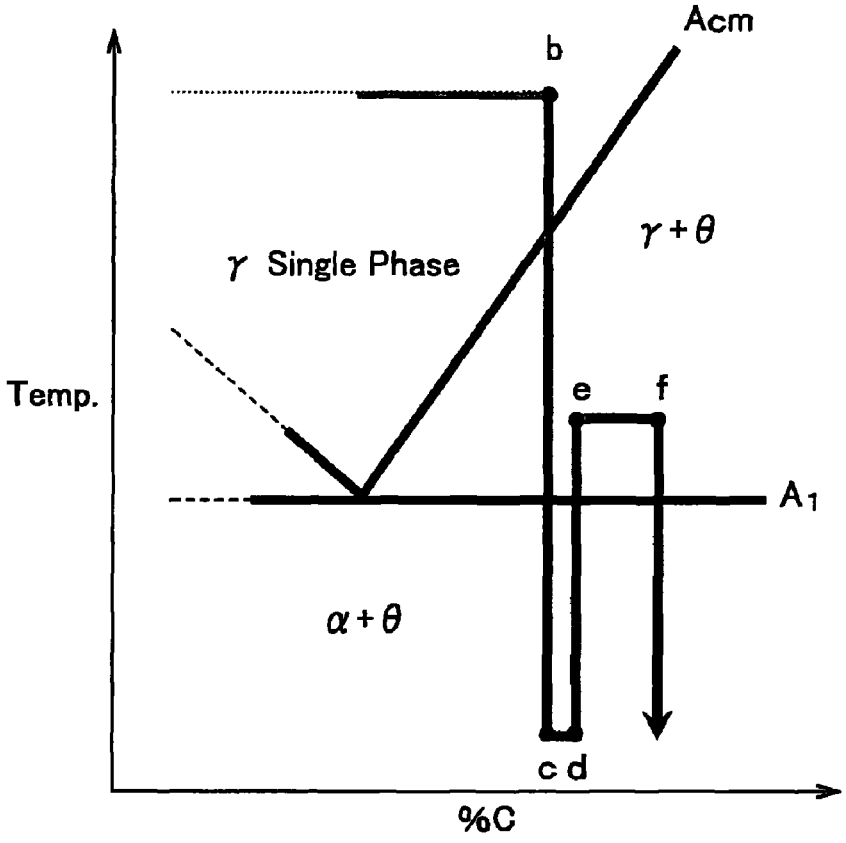
Figure 3:
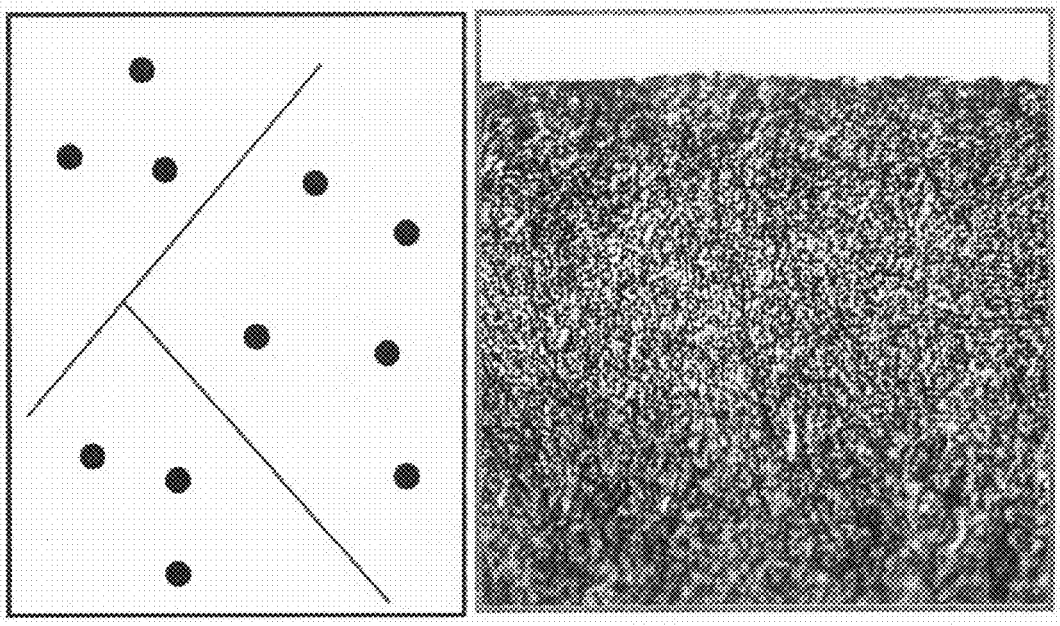
FIG. 3 shows sectional pattern diagrams and sectional observed views of the steel during carburizing process.
Figure 3:
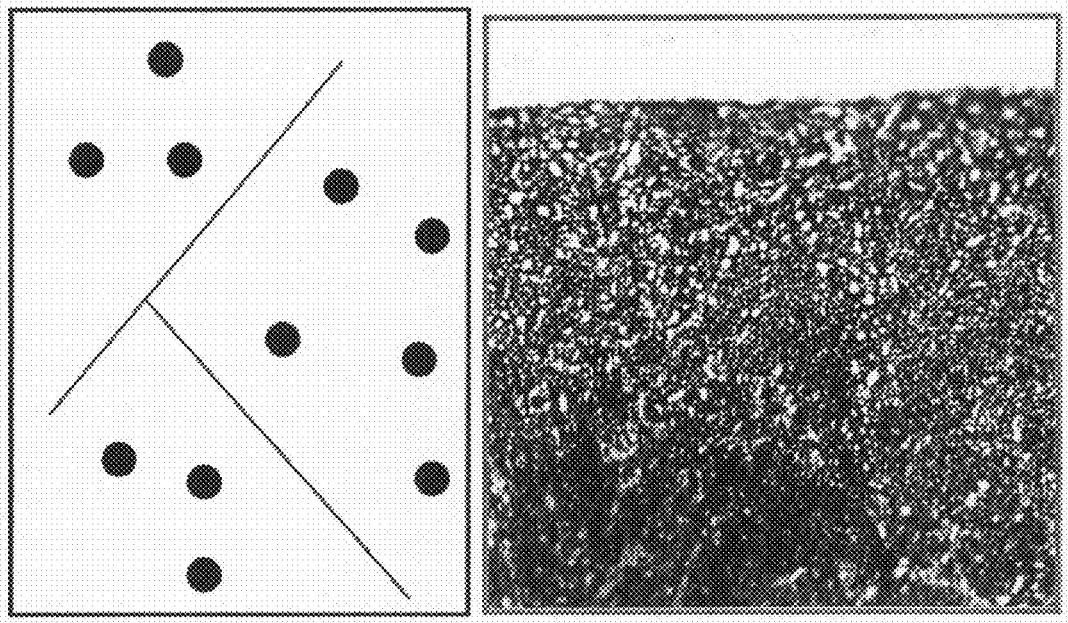
Figure 4:
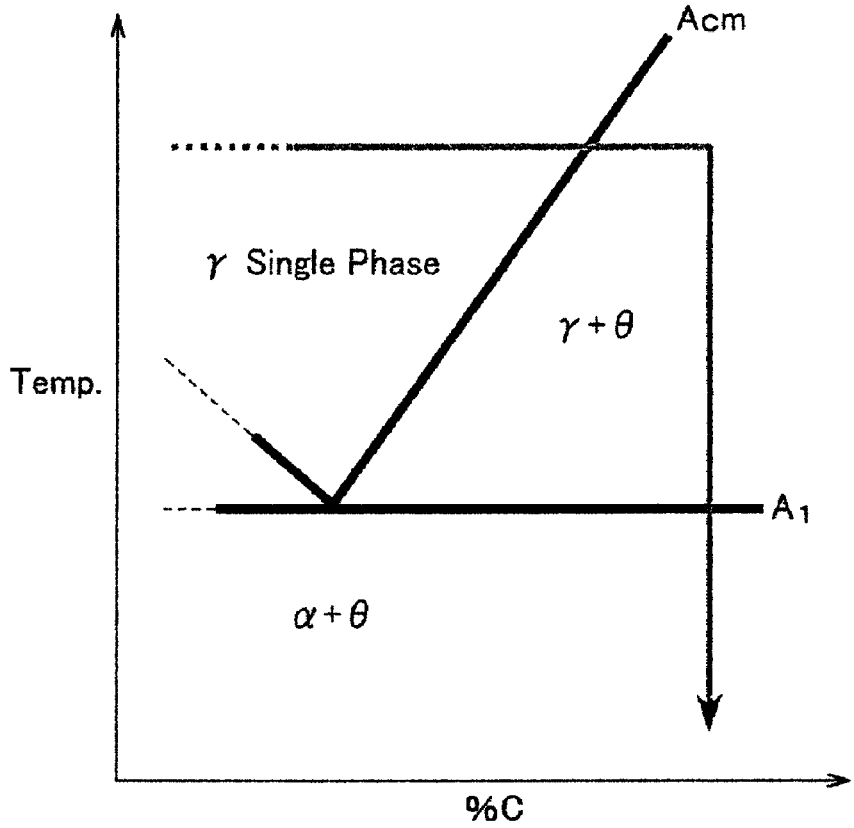
FIG. 4 shows a explanatory diagram and a sectional observed view of an example for carburizing process different from the present invention.
Figure 4:
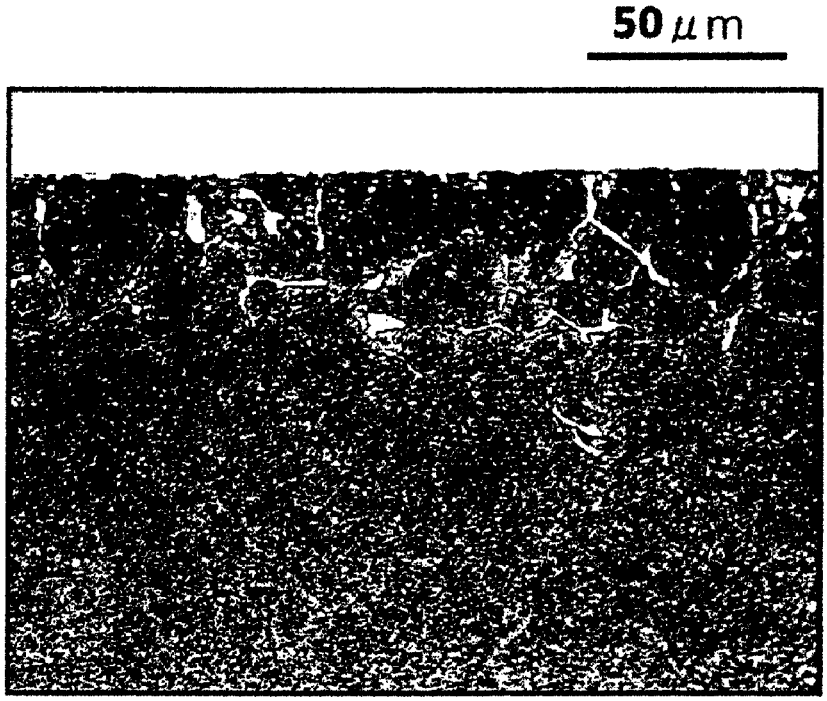

Hereinafter, tests conducted in order to confirm the effects of the present invention will be explained.

First, steel having a chemical composition shown in Table 1 of 150 kg was molten in a high-frequency vacuum induction furnace. The obtained steel ingot was rolled or hot-forged to be a round bar having a diameter of 90 mm, and further hot-forged to be a round bar having a diameter of 22 mm to 32 mm, both ends inclusive, as required, so as to obtain a test material.

TABLE 1

| | C wt % | Si wt % | Mn wt % | Cr wt % | Mo wt % | V wt % | Nb wt % | Annealing Hardness HRB | Surface C Concentration wt % | Carbide Area Ratio % | ≦10 μm Area Ratio % | Presence of ≧15 μm Carbide | Carbide Type |
|---|---|---|---|---|---|---|---|---|---|---|---|---|---|
| 1* | 0.07* | 0.41 | 0.49 | 3.44 | 0.00 | 0.00 | 0.00 | 76 | 2.32% | 35% | 92% | Absent | 100% M3C |
| 2 | 0.22 | 0.31 | 0.39 | 3.02 | 0.00 | 0.00 | 0.00 | 74 | 1.91% | 25% | 95% | Absent | 100% M3C |
| 3* | 0.49* | 0.63 | 0.50 | 5.90 | 0.00 | 0.00 | 0.00 | 93* | 3.31% | 66% | 87% | Absent | 100% M3C |
| 4* | 0.21 | 0.03* | 0.55 | 5.01 | 0.00 | 0.00 | 0.00 | 75 | 3.42% | 61% | 62%* | Present* | 100% M3C |
| 5 | 0.22 | 0.13 | 0.44 | 4.30 | 0.00 | 0.00 | 0.00 | 77 | 2.88% | 51% | 93% | Absent | 100% M3C |
| 6 | 0.23 | 0.46 | 0.40 | 3.20 | 0.00 | 0.00 | 0.00 | 80 | 2.39% | 37% | 100% | Absent | 100% M3C |
| 7 | 0.20 | 0.77 | 0.35 | 3.30 | 0.00 | 0.00 | 0.00 | 82 | 2.42% | 40% | 98% | Absent | 100% M3C |
| 8* | 0.18 | 1.25* | 0.52 | 2.00 | 0.00 | 0.00 | 0.00 | 88 | 1.15%* | 10% | 100% | Absent | 100% M3C |
| 9* | 0.21 | 0.46 | 0.10* | 2.30 | 0.00 | 0.00 | 0.00 | 73 | 1.92% | 28% | 93% | Absent | 100% M3C |
| 10 | 0.18 | 0.67 | 0.55 | 4.48 | 0.00 | 0.00 | 0.00 | 81 | 2.43% | 42% | 98% | Absent | 100% M3C |
| 11* | 0.23 | 0.65 | 1.54* | 4.21 | 0.00 | 0.00 | 0.00 | 92* | 2.27% | 38% | 94% | Absent | 100% M3C |
| 12* | 0.22 | 0.36 | 0.52 | 1.85* | 0.00 | 0.00 | 0.00 | 74 | 1.82% | 24% | 96% | Absent | 100% M3C |
| 13 | 0.23 | 0.53 | 0.53 | 2.52 | 0.00 | 0.00 | 0.00 | 78 | 2.01% | 33% | 97% | Absent | 100% M3C |
| 14* | 0.19 | 0.78 | 0.48 | 6.44* | 0.00 | 0.00 | 0.00 | 91* | 3.03% | 58% | 82% | Absent | 100% M3C |
| 15 | 0.21 | 0.52 | 0.59 | 3.57 | 0.25 | 0.00 | 0.00 | 82 | 1.83% | 25% | 94% | Absent | 100% M3C |
| 16 | 0.19 | 0.45 | 0.38 | 4.64 | 0.00 | 0.44 | 0.00 | 77 | 2.44% | 38% | 96% | Absent | 100% M3C |
| 17 | 0.25 | 0.70 | 0.45 | 3.42 | 0.27 | 0.40 | 0.00 | 84 | 2.37% | 43% | 98% | Absent | 100% M3C |
| 18 | 0.30 | 0.11 | 0.49 | 4.02 | 0.00 | 0.00 | 0.08 | 87 | 2.33% | 35% | 93% | Absent | 100% M3C |
| 19 | 0.31 | 0.21 | 0.98 | 3.21 | 0.00 | 0.22 | 0.03 | 86 | 2.41% | 40% | 93% | Absent | 100% M3C |
| 20* | 0.23 | 0.77 | 0.53 | 8.52* | 0.00 | 0.00 | 0.00 | 91* | 4.22%* | 70% | 80% | Absent | 100% M3C |

TABLE 1-continued

| | C wt % | Si wt % | Mn wt % | Cr wt % | Mo wt % | V wt % | Nb wt % | Annealing Hardness HRB | Surface C Concentration wt % | Carbide Area Ratio % | ≦10 μm Area Ratio % | Presence of ≧15 μm Carbide | Carbide Type |
|---|---|---|---|---|---|---|---|---|---|---|---|---|---|
| 21 | 0.22 | 0.31 | 0.39 | 3.02 | 0.00 | 0.00 | 0.00 | 74 | 2.01% | 24% | 95% | Absent | 100% M3C |
| 22 | 0.19 | 0.65 | 0.55 | 2.00 | 0.00 | 0.00 | 0.00 | 75 | 1.65% | 21% | 100% | Absent | 100% M3C |
| 23 | 0.20 | 0.53 | 0.55 | 2.33 | 0.00 | 0.00 | 0.00 | 74 | 1.70% | 22% | 100% | Absent | 100% M3C |
| 24 | 0.21 | 0.40 | 0.55 | 2.85 | 0.00 | 0.00 | 0.00 | 74 | 1.75% | 25% | 100% | Absent | 100% M3C |

*indicates that the value is out of the range of the present invention.

The obtained test materials were evaluated as follows:

(1) Manufacturability Evaluation (Material Machinability)

Manufacturability was evaluated by evaluating hardness after annealing. That was, a normalizing process at 920° C. for one hour is applied to a round bar test piece having a diameter of 32 mm and a length of 100 mm, and further a annealing process at 760° C. for five hours was applied. The obtained test piece was measured at a position of half radius of the cross-section (cross-section perpendicular to the axis) with Rockwell Hardness B-Scale, HRB, according to JIS: Z2245, and HRB 90 or less was determined as excellent machinability.

(2) Carburization Basic Property Evaluation (2-1) Carburizing Process Method

Round bar test pieces having a length of 100 mm were produced respectively as carburizability test pieces from forged steel bars having diameters of 10 mm and 20 mm. The carburizing process used a vacuum carburizing furnace, and acethylene as carburizing gas, and by controlling a propane gas flow rate, carburizing diffusion time and a carburizing temperature, the surface C concentration was controlled within a range of 1.15% by mass to 4.01% by mass, both ends inclusive. Additionally, the carburizing conditions were as follows:

The first carburizing process: In order to have a top surface C concentration of approximately 1.0% by mass, after applying a carburizing process at 1100° C. for seventy minutes, the test piece was rapidly quenched by gas cooling to a temperature range of 500° C. or less, so as to infiltrate C into the steel to a high concentration range that carbide did not precipitate.

The second carburizing process: According to a target carburizing concentration, after applying a precipitation process by retaining a temperature range of 850° C. to 900° C., both ends inclusive, and further according to a target C concentration, a carburizing process was conducted in a temperature range of 850° C. to 900° C., both ends inclusive, for 60 to 120 minutes, both ends inclusive, and then a quenching process was conducted in an oil tank of 130° C. Also, after the quenching process, a tempering process was conducted at 180° C. for 120 minutes. Additionally, for the test piece No. 21, a steel ball having a diameter of 0.6 mm and hardness of 700 Hv was used, and after carburizing, shot-peening was applied under a condition having a coverage of 300% and a arc height of 0.5 mmA.

(2-2) Evaluation Items

Hereinafter, items for which the evaluation was conducted will be explained. The evaluation results are shown in Table 2.

Surface C concentration: After the carburizing process, a C concentration at 25 μm deep from a surface of the processed test piece was measured by EPMA (Electron Probe Microanalysis) combined with SEM.

Carbide area ratio: A cross-section of the round bar test piece, which had been carburized, quenched and tempered, was polished and corroded with picral etchant, and then a photography thereof was taken at 25 μm deep from the top surface by SEM (observation magnification of 3000×), and by image analysis the area ratio was measured.

Carbide size: The area ration of carbide having 10 μm or less was measured by observing the same conditions as above.

Presence of cancellous carbide: Presence of cancellous carbide was examined by observing the same conditions above.

Presence of imperfectly-quenched structure: A cross-section of the round bar test piece, which had carburized, quenched and tempered, was polished, corroded with nital etchant, and then observed at 25 μm deep from the top surface with an optical microscope, so as that presence of an imperfectly-quenched structure was examined.

Depth of grain boundary oxidized layer: A cross-section of the round bar test piece, which had carburized, quenched and tempered, was polished, and then observed with an optical microscope in a uncorroded state, so as that depth of a blackish layer along the grain boundary of the top surface was measured.

Temper softening resistance: The round bar test piece, which had carburized, quenched and tempered, was further tempered at 300° C. for 180 min., polished, and then measured at 25 μm deep from the top surface with Vickers Hardness (test weight: 200 g)Hv according to a method specified in JIS:Z2244, also determining that the strength improving effect was sufficient in a case Hv750 or more was obtained (The strength was improved 30% or more comparing with a gas eutectoid carburized piece composed of SCR420 material).

Identification of carbide volume ratio: It was conducted by measuring an X-ray diffraction profile as explained above. The above tests were conducted respectively using a test piece having a diameter of 10 mm.

Non-carburized layer strength: Using a test piece of a diameter of 20 mm, a cross sectional center portion of the test piece was measured with Rockwell Hardness C-scale, HRC, and the non-carburized layer strength having HRC 30 or more is determined as accepted.

Surface fatigue strength evaluation: A fatigue test was conducted by a widely-known roller pitching testing machine, and load surface pressure causing no roller pitching at $10^7$ cycle was defined as the surface fatigue strength, so as to conduct the evaluation. Specifically, a round bar having a diameter of 32 mm was first heated and retained at 950° C., and then slowly-cooled to be softened, and a roller pitching test piece having a test part diameter of 26 mm was fabricated by machining. Also, ball-bearing steel (SUJ2) was used as a material of an opposing roller to the test piece, and quenching and tempering processes were applied so as to have a hardness of HRC61. Additionally, a curvature radius of the big roller was 150 R or 700 R. A carburizing process to the test piece was conducted simultaneously with the carburizing process conducted in order to conduct the above-described basic evaluation test of the inventive steel. Additionally, after the carburizing process, a part of the pitching test piece was tempered by retained at 300° C. for 3 hours, and then evaluated with surface C concentration, carbide area ratio, maximum carbide size and tempering hardness. Also, the surface fatigue strength set surface fatigue strength of the gas eutectoid carburized piece specified in JIS:SCR420 as a reference value (1.0), each material strength was shown with a magnification index to the reference value, and in a case of achieving the surface fatigue strength of 30% or more than the reference value, it was determined that the strength improving effect was sufficient. The above results are shown in Table 2.

TABLE 2

| | Cancellous Carbide | Imperfectly-Tempered Structure | Grain Boundary Oxidized layer Depth | Core Hardness | 300° C. Tempering Hardness Hv | Equation 1 Cr Lower Limit | Equation 1 Cr Upper Limit | Evaluation | Surface Fatigue Strength Ratio Index | Surface Fatigue Strength Ratio Evaluation | Special Note |
|---|---|---|---|---|---|---|---|---|---|---|---|
| 1* | Absent | Absent | Absent | NG* | 803 | 3.02 | 5.02 | ○ | 1.42 | ○ | The non-carburized layer strength was NG. |
| 2 | Absent | Absent | Absent | OK | 757 | 2.30 | 4.30 | ○ | 1.30 | ○ | OK |
| 3 | Absent | Absent | Absent | OK | 899 | 4.77 | 6.77 | ○ | 1.63 | ○ | The material machinability was NG. |
| 4* | Absent | Absent | Absent | OK | 877 | 4.92 | 6.92 | ○ | 1.21* | X* | The surface fatigue strength was NG. |
| 5 | Absent | Absent | Absent | OK | 832 | 4.01 | 6.01 | ○ | 1.47 | ○ | OK |
| 6 | Absent | Absent | Absent | OK | 803 | 3.15 | 5.15 | ○ | 1.35 | ○ | OK |
| 7 | Absent | Absent | Absent | OK | 835 | 3.20 | 5.20 | ○ | 1.44 | ○ | OK |
| 8* | Absent | Absent | Absent | OK | 740* | 0.96 | 2.96 | ○ | 1.22* | X* | The surface C concentration did not increase, resulting in the insufficient surface fatigue strength. |
| 9* | Absent | Present* | Absent | OK | 720* | 2.32 | 4.32 | X | 0.90* | X* | The hardenability was NG. |
| 10 | Absent | Absent | Absent | OK | 841 | 3.22 | 5.22 | ○ | 1.43 | ○ | OK |
| 11 | Absent | Absent | Absent | OK | 820 | 2.94 | 4.94 | ○ | 1.42 | ○ | The material machinability was NG. |
| 12* | Absent | Present* | Absent | OK | 702* | 2.14 | 4.14 | X* | 0.90* | X* | The hardenability was NG. |
| 13 | Absent | Absent | Absent | OK | 792 | 2.48 | 4.48 | ○ | 1.33 | ○ | OK |
| 14* | Absent | Absent | Absent | OK | 897 | 4.27 | 6.27 | X* | 1.51 | ○ | The material machinability was NG. |
| 15 | Absent | Absent | Absent | OK | 796 | 2.16 | 4.16 | ○ | 1.33 | ○ | OK |
| 16 | Absent | Absent | Absent | OK | 811 | 3.23 | 5.23 | ○ | 1.34 | ○ | OK |
| 17 | Absent | Absent | Absent | OK | 827 | 3.11 | 5.11 | ○ | 1.41 | ○ | OK |
| 18 | Absent | Absent | Absent | OK | 793 | 3.04 | 5.04 | ○ | 1.33 | ○ | OK |
| 19 | Absent | Absent | Absent | OK | 810 | 3.18 | 5.18 | ○ | 1.40 | ○ | OK |
| 20* | Absent | Absent | Absent | OK | 934 | 6.37 | 8.37 | X* | 1.71 | ○ | Satisfying the required Cr amount to the surface C concentration resulted in the insufficient material machinability. |
| 21 | Absent | Absent | Absent | OK | 866 | 2.48 | 4.48 | ○ | 1.76 | ○ | OK (shot-peening conducted.) |
| 22 | Absent | Absent | Absent | OK | 750 | 1.84 | 3.84 | ○ | 1.30 | ○ | OK |
| 23 | Absent | Absent | Absent | OK | 766 | 1.93 | 3.93 | ○ | 1.34 | ○ | OK |
| 24 | Absent | Absent | Absent | OK | 786 | 2.02 | 4.02 | ○ | 1.39 | ○ | OK |

*indicates that the value is out of the range of the present invention.

According to the above results, it can be recognized that the respective example pieces do not show imperfectly-quenched structures, cancellous carbide, or grain boundary oxidization, which cause strength deterioration, and have excellent manufacturability (annealing hardness≦HRB90), can obtain tempering hardness (≧750 Hv) at 300° C. sufficiently, and have excellent fatigue strength.

What is claimed is:

1. A carburized component having a base metal comprised of a steel containing:

C: 0.10% by mass to 0.40% by mass;

Si: 0.05% by mass to 0.8% by mass;

Mn: 0.35% by mass to 1.2% by mass;

Cr: 2.0% by mass to 4.64% by mass;

both ends inclusive, and remnant including Fe and inevitable impurities, having a carburized layer formed on a surface layer portion of said base metal, having a grain boundary oxidized layer depth of 1 μm or less on a surface thereof and an average C concentration SC of 1.5% by mass to 4.0% by mass, both ends inclusive, at 25 μm deep from the surface, and adjusted so as to satisfy:

$$1.76SC-1.06<WCr<1.76SC+0.94 \quad (1)$$

where WCr represents a Cr content of the steel composing said base metal, wherein said carburized layer also has, in a sectional structure in depth direction thereof, a carbide area ratio of 15% to 60%, both ends inclusive, at 25 μm deep from the surface, a fine carbide area ratio, having a dimension of 0.5 μm to 10 μm, both ends inclusive, constitutes 80% or more of the total carbide area, and further $M_3C$ type carbide accounts for 70% by volume or more of said fine carbide, wherein M is a metal.

2. The carburized component according to claim 1, wherein said steel further contains at least one of:

Mo: 0.2% by mass to 1.0% by mass; and

V: 0.2% by mass to 1.0% by mass, both ends inclusive.

3. The carburized component according to claim 1, wherein said steel further contains:

Nb of 0.02% by mass to 0.12% by mass, both ends inclusive.

4. The carburized component according to claim 2, wherein said steel further contains:

Nb of 0.02% by mass to 0.12% by mass, both ends inclusive.

* * * * *